United States Patent [19]

Giordano et al.

[11] 4,383,386

[45] May 17, 1983

[54] TOY SKILLET AND KNIFE HAVING SIMULATED SOUND-PRODUCING CAPABILITIES

[75] Inventors: George P. Giordano, Cincinnati; Maximino Almanza, Fairfield; Allen F. Eberts; William R. La Dow, both of Cincinnati, all of Ohio

[73] Assignee: CPG Products Corp., Minneapolis, Minn.

[21] Appl. No.: 232,331

[22] Filed: Feb. 6, 1981

[51] Int. Cl.[3] ..... A63H 3/52; A63H 33/26

[52] U.S. Cl. ..... 46/14; 46/232

[58] Field of Search ..... 46/232, 228, 227, 14, 46/39; 219/383, 543; 340/384 E, 384 R, 568; 99/358

[56] References Cited

U.S. PATENT DOCUMENTS

| | | | |
|---|---|---|---|
| 3,036,402 | 5/1962 | Hamilton | 46/39 |
| 3,091,051 | 5/1963 | Glass et al. | 46/14 |
| 3,120,717 | 2/1964 | Glass et al. | 46/232 X |
| 3,262,382 | 7/1966 | Williams | 219/383 X |
| 3,490,170 | 1/1970 | Wolf | 46/232 UX |
| 4,160,339 | 7/1979 | Dankman et al. | 46/232 X |
| 4,273,682 | 6/1981 | Kanamori | 252/511 |
| 4,282,681 | 8/1981 | McCaslin | 46/227 X |

*Primary Examiner*—Mickey Yu

*Attorney, Agent, or Firm*—Gene O. Enockson; L. MeRoy Lillehaugen; Stuart R. Peterson

[57] ABSTRACT

A battery powered toy in the form of a skillet has a simulated cooking surface of dielectric material containing thereon a grid of electrically conductive strips which are normally electrically insulated from each other by reason of the dielectric cooking surface that exists between the strips. When a deformable material, such as Play-Doh® brand modeling compound, having a sufficiently low electrical conductivity is kneaded or cut into the shape of an article of food and is manually placed on the cooking surface so as to bridge or span portions of the electrically conductive strips constituting the grid, the deformable material completes a circuit that activates a noise signal generator which produces through the agency of a small speaker a sizzling sound resembling that of frying food. Provision is made for a realistic build-up of the frying sound when the deformable material is first placed on the cooking surface, and also a realistic decaying or fading of the frying sound is provided when the "food" is removed from the cooking surface. The noise signal generator, speaker and other electronic components are contained in the handle of a toy knife. The knife has a blade formed of a central strip of dielectric material which is sandwiched between adjacent metal foil contacts or strips. When the knife is removed from the skillet and the blade pressed against some of the electrically conductive deformable material, a circuit is completed which causes the speaker to emit a sound resembling that of an electric slicing knife. Undue drain on the battery is prevented until the circuit is completed through the deformable material and the skillet grid or through the deformable material and the knife blade.

43 Claims, 14 Drawing Figures

9
9

TOY SKILLET AND KNIFE HAVING SIMULATED SOUND-PRODUCING CAPABILITIES

BACKGROUND OF THE INVENTION

1. Field of the Invention

This invention relates to a toy especially suited for young girls, and pertains more particularly to a battery-operated toy which produces a sound resembling the frying of food or a sound resembling the slicing of food with an electric knife.

2. Description of the Prior Art

Toy cooking utensils which produce simulated cooking sounds are not entirely new. One example of a toy cooking utensil is disclosed in U.S. Pat. No. 3,120,717, issued to Marvin I. Glass et al. on Feb. 11, 1964 for "Toy Cooking Utensil With Sounding Means". In this patented construction, crumpled sheets of metal foil or the like are rubbed against each other, an electric motor causing the relative movement to occur. Realism is lost in that the sound is produced irrespective of the presence of any "food" on the cooking surface.

U.S. Pat. No. 3,831,314, issued on Aug. 27, 1974 to Sidney Bass for "Pneumatic Toy Stove Accessory" requires the presence of a food-simulating member. However, the food simulating member must be relatively flat and flexible in that a cooking sound is produced by means of air under pressure which bubbles up from under the flexible food-simulating member, doing so through water that must also be contained in the utensil. Both the skillet and a toy stove have to be used in combination, the combination involving rather complex and expensive components.

SUMMARY OF THE INVENTION

One object of our invention is to provide a toy cooking utensil in the form of a skillet that will possess a greater degree of realism than heretofore. It is also an aim of the invention to provide a knife which adds to the overall realism of the combination. It is contemplated that the knife be releasably held by the skillet, the knife's handle while being held by the skillet appearing to be the skillet's handle with the knife blade under these circumstances being concealed beneath the skillet.

Another object of the invention is to produce two distinctly different sounds. In this regard, an aim of the invention is to provide one sound that simulates the frying of food in a skillet and a second sound that resembles the cutting of food with an electric slicing knife.

Another object of the invention is to provide a toy cooking utensil and knife combination, the use of either requiring that the child first cut, knead or manually mold a deformable material having a sufficient degree of electrical conductivity into various articles of food, or at least into a form that could be deemed to resemble a food item, in order to derive either a sound simulating that of frying or that of an electric knife.

The invention also has for an object, which is closely allied with the preceding object, to require that a simulated article of food be appropriately positioned or placed for the purpose of completing a circuit to provide a simulated cooking sound, more specifically that resembling the frying of food, or to complete a circuit to provide a cutting sound, more specifically that resembling the slicing of food with an electric knife.

Still another object of the invention is to maintain both the utensil and knife silent until a deformable material capable of completing a desired circuit has been included, there being no sound until the simulated food article is brought into juxtaposition with either the cooking surface of the utensil to create the impression of cooking the article or the knife blade has engaged such material for the purpose of performing a make-believe slicing of such article.

Also, the invention has for an object the dual utilization of certain components for producing the two sounds. More specifically, an aim of the invention is to have all of the sound-producing components contained in the handle of the knife, thereby permitting certain of the components to be used when a cooking sound is to be provided and also enabling those same components to be used when providing a simulated knife cutting sound.

The invention has for another object the provision of circuitry that will not produce a significant drain on the battery supplying power for the sound-producing means until a sound is to be produced, either by placing a deformable material that is sufficiently electrically conductive on the skillet to complete a circuit to the sound-producing means or by engaging the knife blade with such material.

Inasmuch as an object of the invention is to provide a high degree of realism as far as simulating two kitchen-related procedures, another object of the invention is to preclude the production of either a cooking sound or a knife cutting sound unless a simulated article of food of the proper electrical conductivity has been utilized. More specifically, an aim of the invention is to provide electrical circuitry having a selected resistance of sufficient value so that the circuitry is not generally responsive to the presence of a child's hand, particularly across the knife blade, yet being responsive to the lower resistance provided by the deformable material made use of when practicing our invention.

Generally, the invention has for an object the provision of a toy, as characterized above, that can be manufactured at a relatively low cost, thereby encouraging the widespread purchase and use of such a toy. For instance, a semiconductor integrated circuit chip can readily be fabricated for providing most of the circuit elements made use of in our invention.

Briefly, our invention contemplates a toy skillet of suitable plastic that is molded so as to releasably hold a toy knife in place with its blade concealed beneath the skillet; the exposed knife handle then appears to be the skillet's handle. An electrically conductive grid is provided on the upper surface of the skillet's bottom wall, the grid comprising two strips of electrically conductive material. When portions of the two electrical strips are bridged by an electrically conductive deformable or moldable compound, a pseudo-random sequence noise generator is energized that produces a sizzling sound via a small speaker that resembles the frying of food. The deformable material or compound having the requisite electrical conductivity must be placed on the grid, that is on the simulated cooking surface, before the frying sound is produced.

When the knife is removed from the skillet, portions of the sides of the blade, which are electrically conductive, function as contacts so that when the same deformable material or compound engages the sides of the knife blade, as when imitating the cutting of food, another sound is produced which resembles that of an electric slicing knife.

Provision is made for preventing the simultaneous production of both sounds.

In producing either sound, it should be appreciated that it is necessary that material having the proper electrical conductivity be engaged with the grid or the sides of the blade, as the case may be. A resistance is selected for the circuitry so that it will not ordinarily be actuated by a person's hand, either to produce the cooking sound or, more importantly, the knife cutting sound. It is also within the contemplation of the invention to increase the frying sound rather gradually (on the order of four seconds) to its full volume once the simulated item of food has been placed on the grid, it being more natural to have a relatively slow build-up of the cooking sound in that it more closely corresponds to the heating up of an actual food item. By the same token, it is planned that the cooking sound slowly decay (also on the order of four seconds) after the artificial item of food has been removed from the skillet.

It is also within the contemplation of the invention to employ means for sensing when the electrically deformable material has completed a circuit via either the skillet or the knife. In this way, the electric circuitry is virtually disconnected from the battery (with the exception of the small amount of power drawn from the battery by the sensing portion of the circuit) until a sound is to be produced, thereby conserving battery power that would otherwise be dissipated. Consequently, the entire toy is for all intents and purposes electrically inactivated until activated by the placing of a deformable material having the appropriate electric conductivity in engagement with the cooking surface having the grid thereon, or when such material is engaged by a specially constructed knife blade.

BRIEF DESCRIPTION OF THE DRAWINGS

FIG. 12 is a combined block and schematic diagram of one form of circuitry that can be employed when practicing our invention;

FIG. 14 is a block diagram depicting a modified form of circuitry that can be utilized to achieve the teachings of our invention.

DESCRIPTION OF THE PREFERRED EMBODIMENTS

Figure 1:
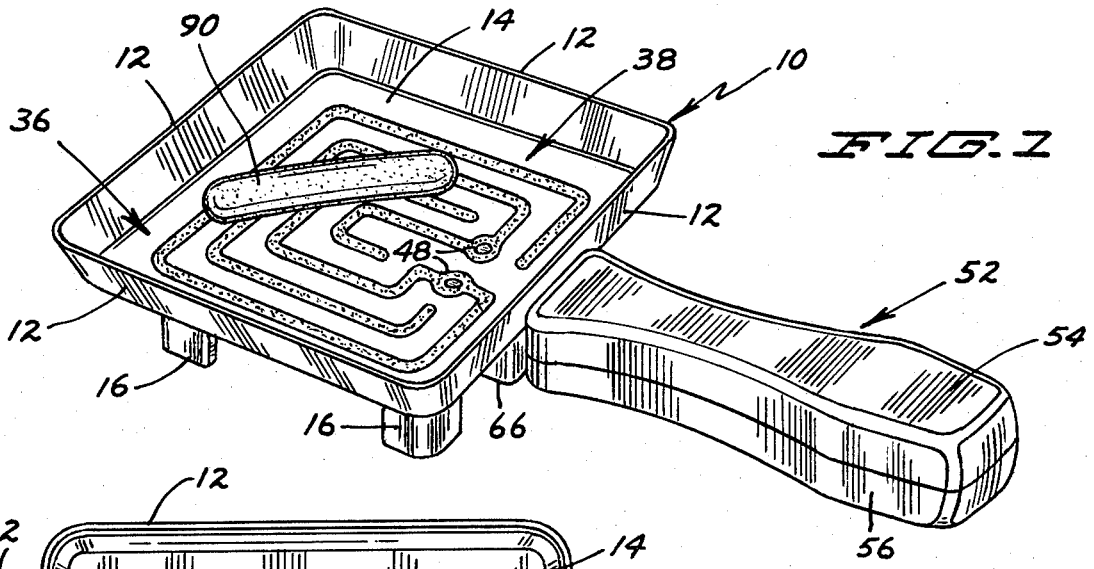
FIG. 1 is a perspective view looking down on a toy skillet exemplifying our invention with a simulated article of food placed on the cooking surface thereof, the view also showing the handle of a knife releasably held by the skillet which handle contains most of the electric circuitry.
Figure 2:
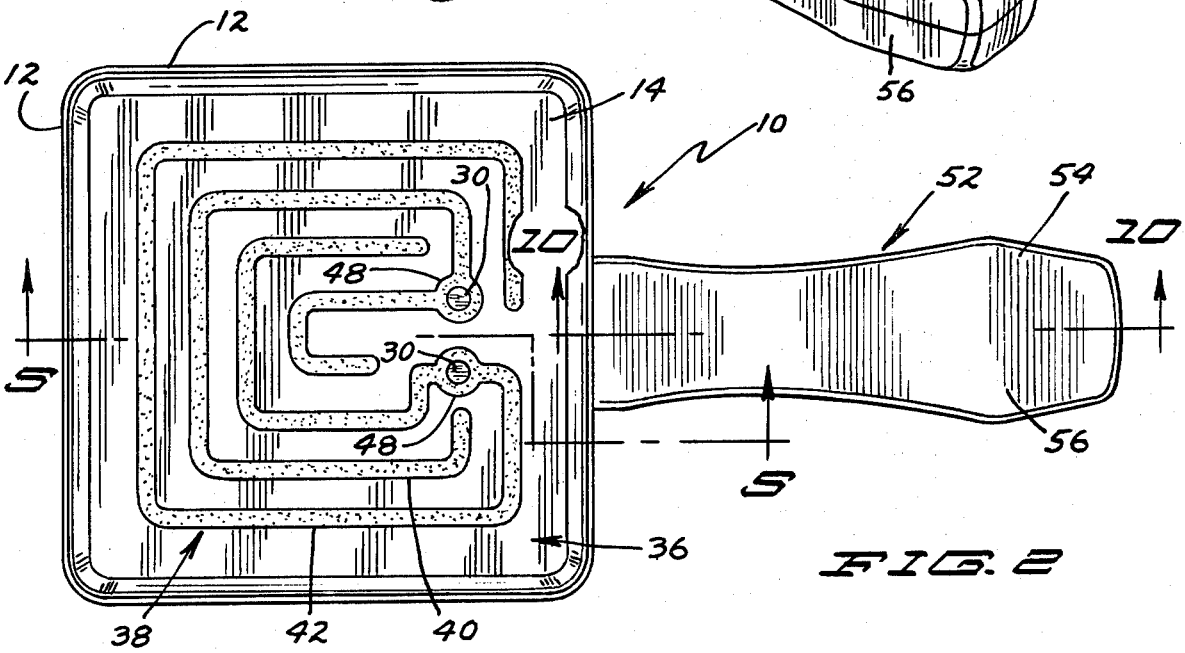
FIG. 2 is a top plan view corresponding generally to FIG. 1.
Figure 3:
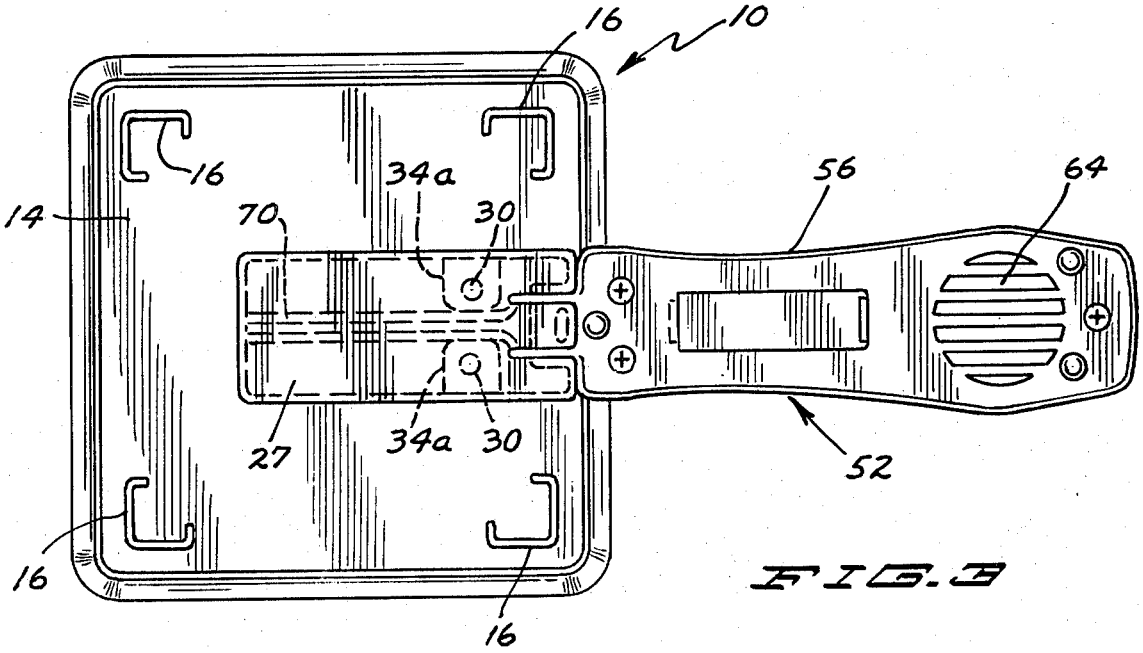
FIG. 3 is a bottom plan view of the skillet and knife of FIGS. 1 and 2.

Referring first to FIGS. 1 and 2, a toy skillet 10 of suitable plastic, such as a styrene plastic, constitutes the particular cooking utensil that will hereinafter be more fully described. The skillet 10 has upwardly and outwardly diverging side walls 12 and a bottom wall 14 integral with the lower edges of the side walls 12. Extending downwardly from the bottom wall 14 are legs 16 that are integrally molded to said bottom wall 14.

Figure 4:
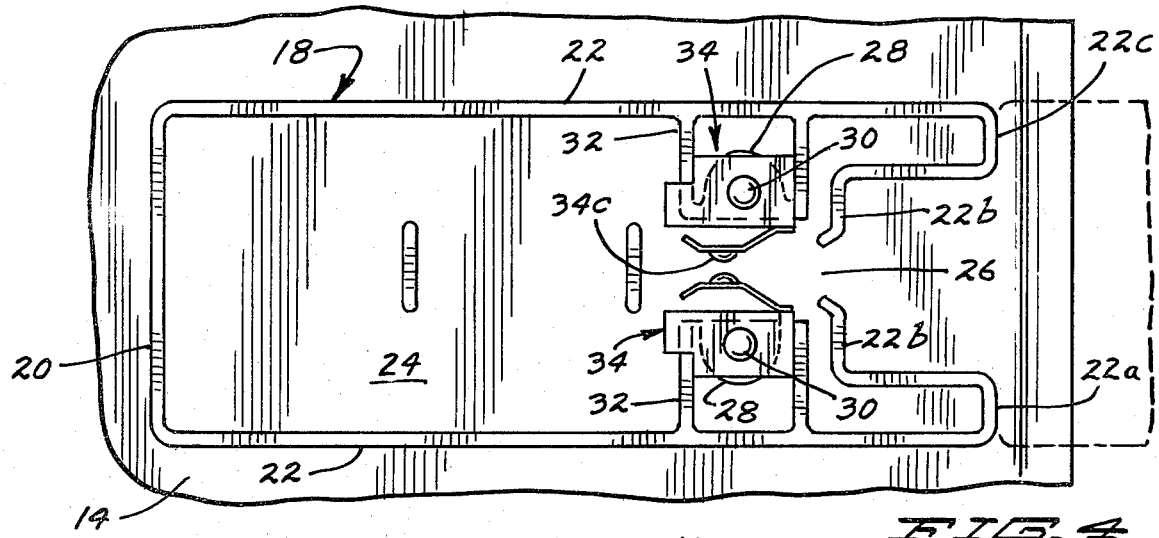
FIG. 4 is an enlarged fragmentary bottom view of the skillet without the knife and without the cover plate that underlies the knife blade as in FIG. 3, the contacts that engage the knife blade thus being visible.
Figure 5:
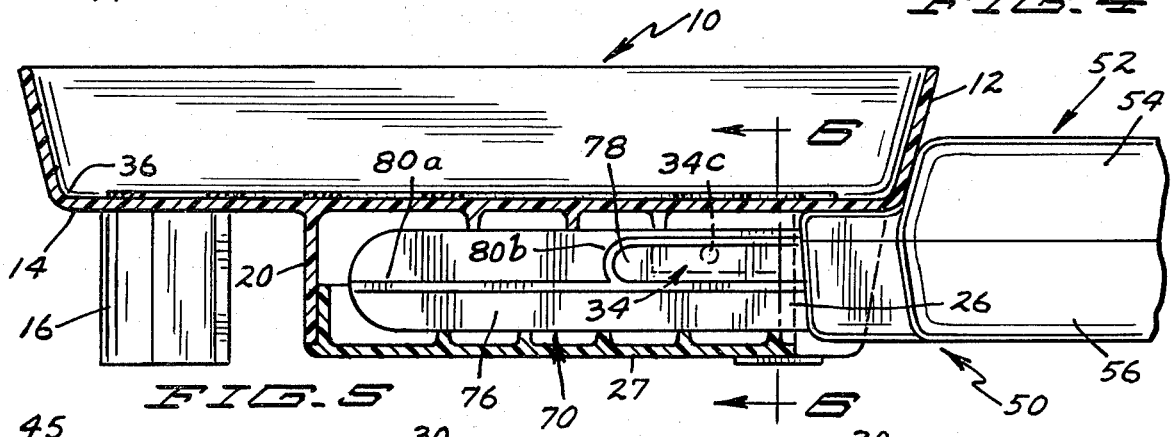
FIG. 5 is a sectional view taken in the direction of line 5—5 of FIG. 2 for the purpose of depicting certain electrical connections between the grid on the cooking surface and the specially fabricated knife blade.

As can best be discerned from FIG. 4, the underside of the bottom wall 14 has a generally rectangular skirt 18 comprised of a rear wall 20, and side walls 22, each side wall 22 having a U-shaped end **22*a* and an inwardly directed flange 22*b*. The skirt 18 forms an inverted well or pocket 24 for the accommodation of a knife blade described hereinafter. Also, the inwardly directed flanges 22*b* are spaced laterally so as to form a slot 26 through which the later-described blade extends. A cover 27 is press-fitted into the skirt 18 so as to close the well or pocket 24**.

Figure 6:
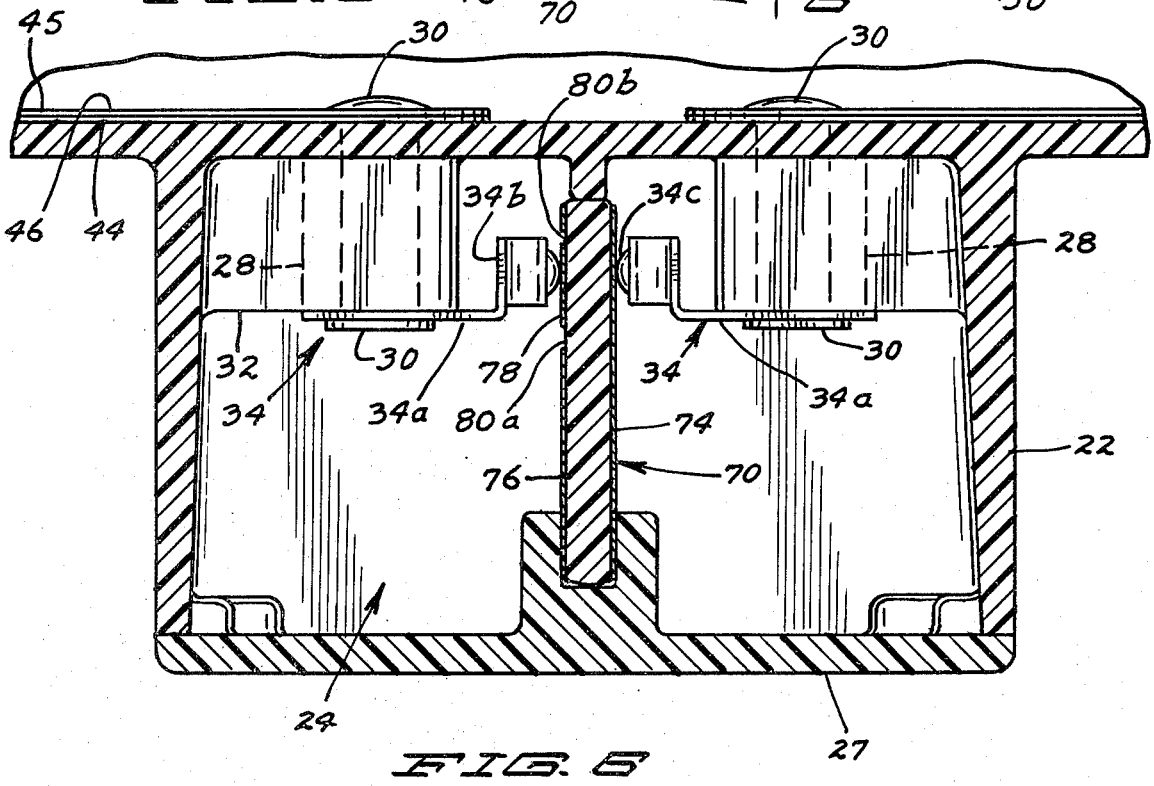
FIG. 6 is a greatly enlarged transverse sectional view taken in the direction of line 6—6 of FIG. 5.

From FIGS. 4 and 6 it can also be perceived that tubular bosses 28 are molded integrally with the bottom wall 14. These tubular bosses 28 each contain a terminal or conductor in the form of a rivet 30 extending upwardly through the bottom wall 14 to the upper side thereof. The lower ends of the bosses 28 terminate in the same horizontal plane as do a pair of U-shaped bosses 32 that have the ends of their legs integral with opposite side walls 22 and which position a pair of sweep contact members 34 formed with a horizontal mounting flange **34*a* having a hole therein through which the rivet 30 extends, and vertical flange 34*b* to which the rounded electrical contact 34*c*** is attached.

The upper side of the bottom wall 14 provides a simulated cooking surface 36 having a grid 38 thereon composed of electrically conductive strips 40 and 42. Each strip 40, 42 is composed of three layers, the first of these being a copper foil 44 that is hot stamped to the upper side of the bottom wall 14 or cooking surface 36, thereby forming an electrically conductive band or ribbon. Superimposed on the copper 44 by a second hot stamping operation, is a layer of charcoal 45. To keep the charcoal 45 from rubbing off the copper 44, a very thin film or coating of silicone 46 is applied to the charcoal 45. These layers 44, 45 and 46 have an exaggerated thickness in FIG. 6. As can be appreciated from FIGS. 1 and 2, the strips 40, 42 each have a circular or disk-like electrical terminal 48 integral therewith, the two terminals 48 being engageable with the previously mentioned terminals or rivets 30 that extend upwardly through the bottom wall 14.

At this stage of the description, reference will be made to a toy knife indicated generally by the reference numeral 50. The knife 50 includes a handle 52 comprised of molded plastic shells 54 and 56, such as high impact styrene. The handle 52, by reason of the configuration of the shells 54 and 56, provide a battery compartment at 58, a speaker compartment at 60 and a component compartment at 62 (in a sense part of the speaker's compartment), the speaker compartment 60 having a plurality of openings 64 through which sound can emanate from the later-described speaker. At the end of the handle 52 opposite or remote from the speaker compartment 60 is a boss or protrusion 66 having a vertical slot 68 therein.

The toy knife 50 has a knife blade 70 composed of a double clad copper epoxy-glass printed circuit board which is nickel plated after portions of the copper have been etched away. One end of the blade 70 is anchored in the boss 68, the remainder projecting through the slot 68 into the pocket 24 between the side walls 22 of the previously mentioned skirt 18. The blade 70 includes a central dielectric strip 72, suggestively an appropriately contoured plastic strip, typically epoxy-glass as mentioned above, which is sandwiched between a first copper foil contact or conductive strip 74 at one side and a second copper foil contact or conductive strip 76 at the other side; see FIG. 7 for the contact 74 and FIG. 8 for the contact 76. From FIG. 8 it will be noted that a third copper foil contact 78 is electrically separated or insulated from the contact 76 by exposed bands **80*a* and 80*b* of the plastic material constituting the central strip 72. The bands 80*a*, 80*b* are formed by etching away (a common practice in making printed circuits) strip sections of the original metal foil having the appearance of the foil contact 74 (FIG. 7) on the other side of the blade 70**.

Figure 13:
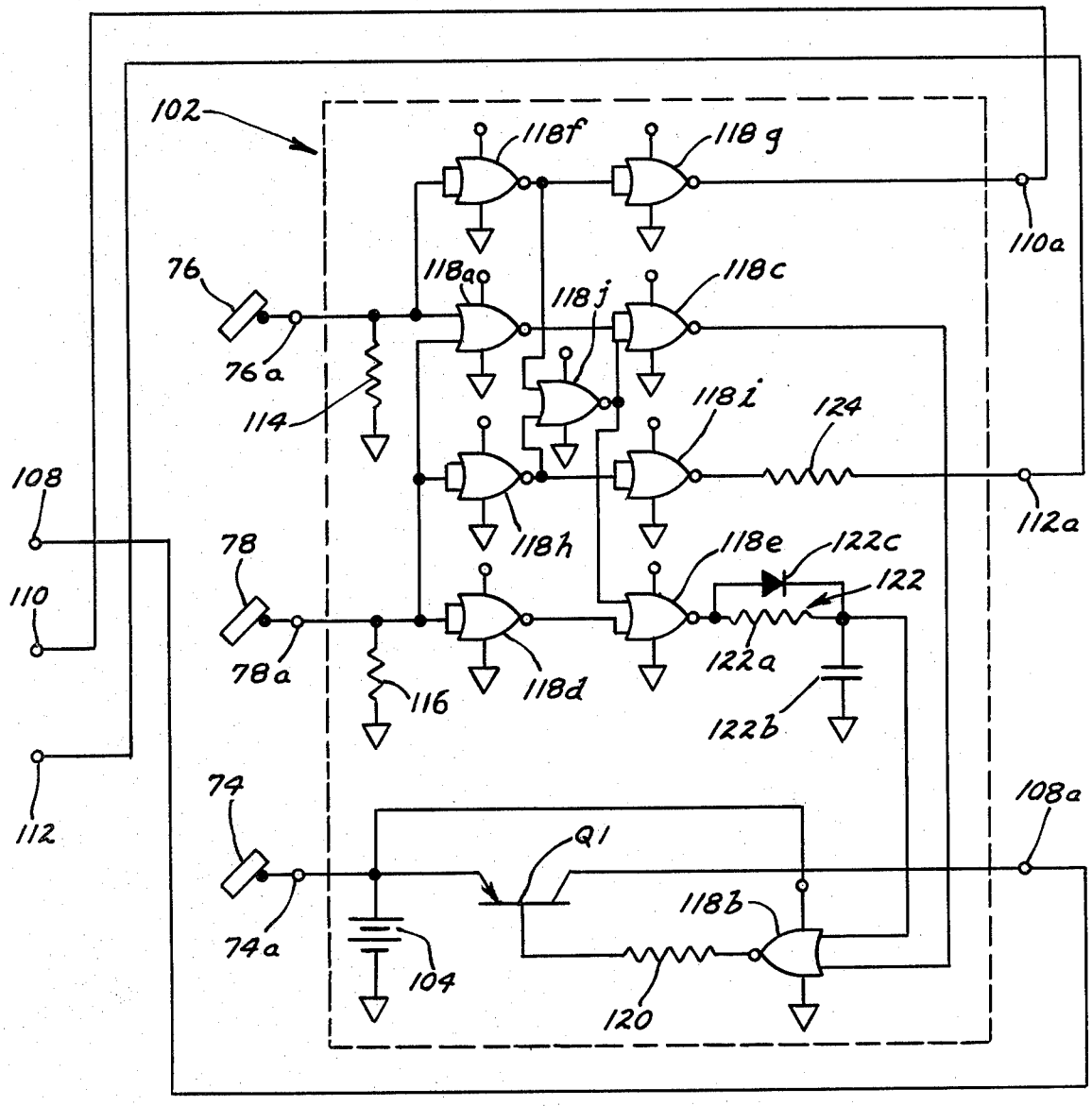
FIG. 13 is a diagrammatic view of the battery supply control circuit shown only in block form of FIG. 12.
Figure 7:
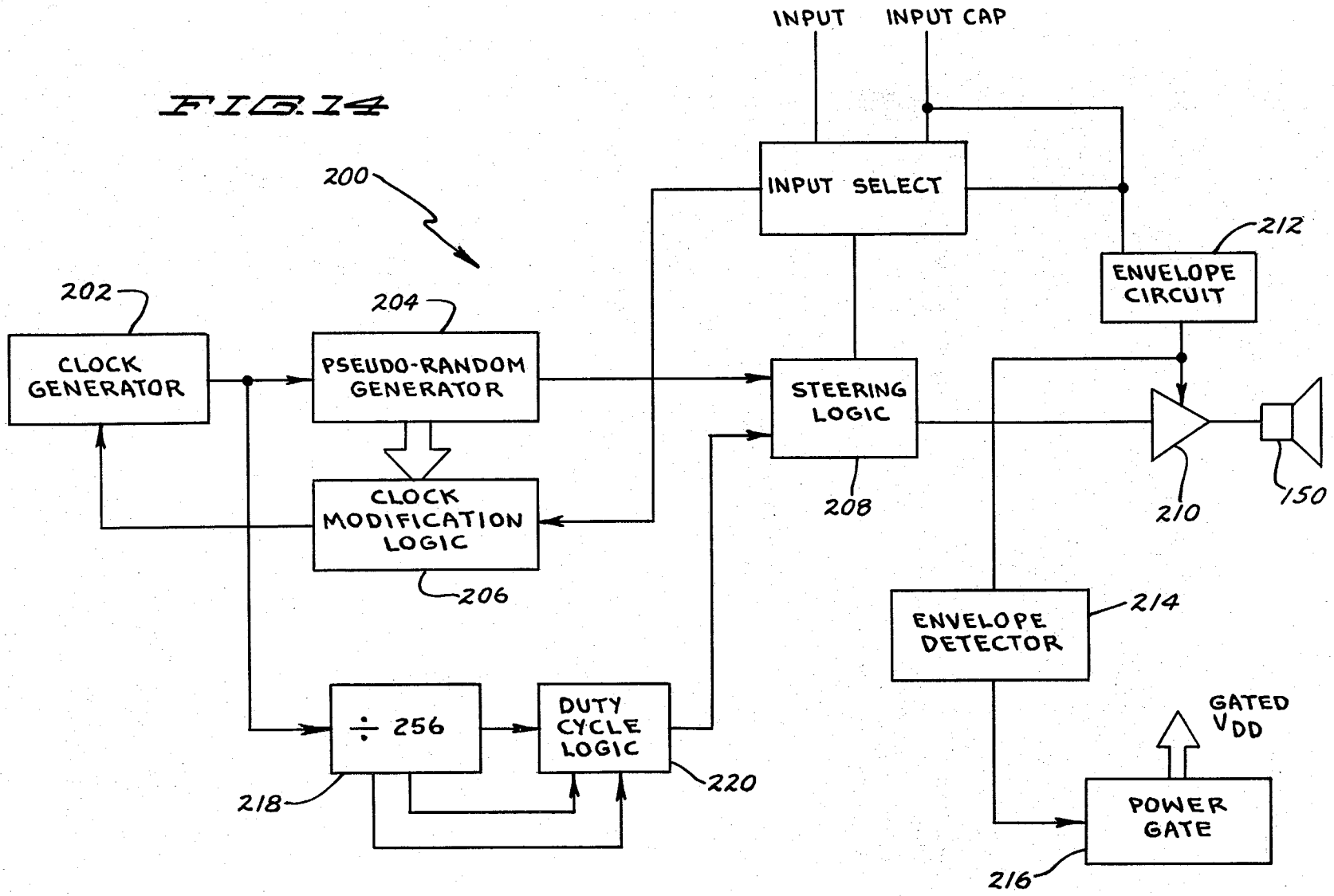

Although it will not be completely understood at this stage of the description, it can be pointed out that the foil contact 74 which covers the entire side of the plastic strip 72 serves as a common electrical contact for circuitry yet to be described. The second foil contact 76 coacts with the contact 74 in completing a circuit when deformable material having a sufficiently low electrical conductivity is engaged by the knife blade 70. On the other hand, the third contact 78 functions to complete a circuit from the common contact 74 when deformable material of the above-alluded to type bridges portions of the strips 40 and 42 of the grid 38 of the cooking surface 36. The reason for the contacts 74, 76 and 78 will be more fully understood as the description progresses, particularly when the circuitry of FIG. 13 is described.

Figures 7, 8, 9, 10:
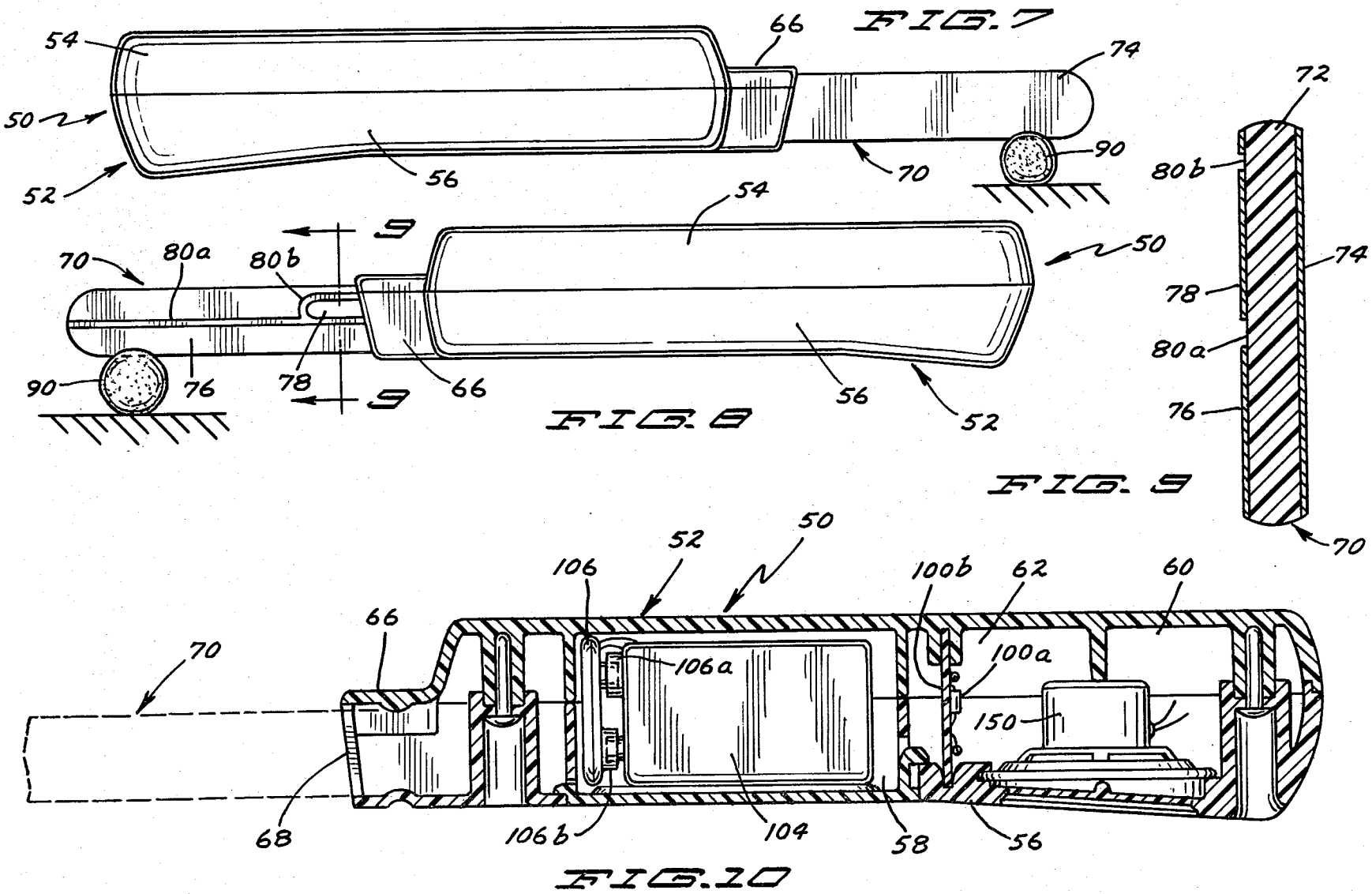
FIG. 7 is a side elevational view of the knife after it has been removed from the skillet, the view showing the metal foil contact at one side of the blade.
FIG. 8 is a view corresponding to FIG. 7 but picturing the other side of the knife blade, this view portraying the two contacts formed by etching away a strip of foil on this side.
FIG. 9 is an enlarged sectional detail taken in the direction of line 9—9 of FIG. 8 for the purpose of showing the foil contacts at each side of the knife blade.
FIG. 10 is a sectional view taken in the direction of line 10—10 of FIG. 2 in order to show the several compartments provided within the generally hollow handle of the knife, a portion of the knife blade appearing in phantom outline at the left.

It is intended that deformable material or composition 90, such as the commercially available product known as Play-Doh® brand modeling compound, having the proper electrical conductivity be employed to complete a circuit as far as the grid 38 (FIG. 1) is concerned and also as far as the blade 70 is concerned (FIGS. 7 and 8). It is also intended that the deformable material 90 be cut or molded by the child into shapes resembling various articles of food. While some leeway is available as far as the composition of the deformable material 90 is concerned, as long as it possesses a sufficiently low electrical conductivity, a suggested composition for the deformable material 90 on a weight percentage basis is: wheat flour 30–60%, water 30–60%, hydrocarbon distillate (kerosene) 1–5% and salt 10–25%. It should be understood that basic reliance is made on the salt for providing the desired degree of electrical conductivity that is sufficiently low so as to initiate the generation of a frying sound or a knife slicing sound, all as will be better understood from the subsequent description. However, it is important that the composition impart a sufficient degree of pliability, much like dough, so that even young children can mold the material 90 into various forms, particularly food configurations.

Figure 11:
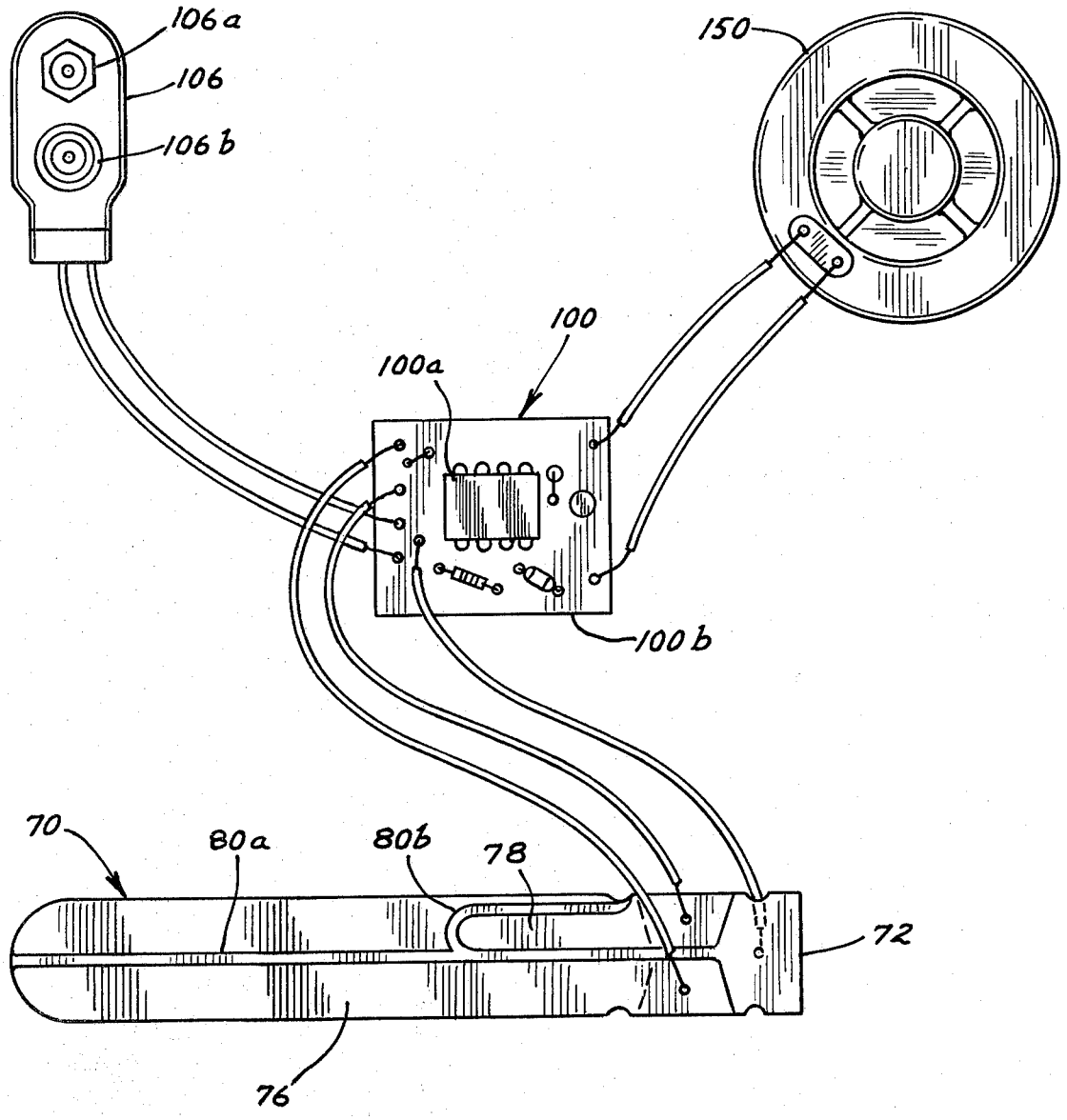
FIG. 11 is a pre-assembly plan view depicting the knife blade, printed circuit board, integrated circuit chip, battery connector and speaker.
Figure 2:
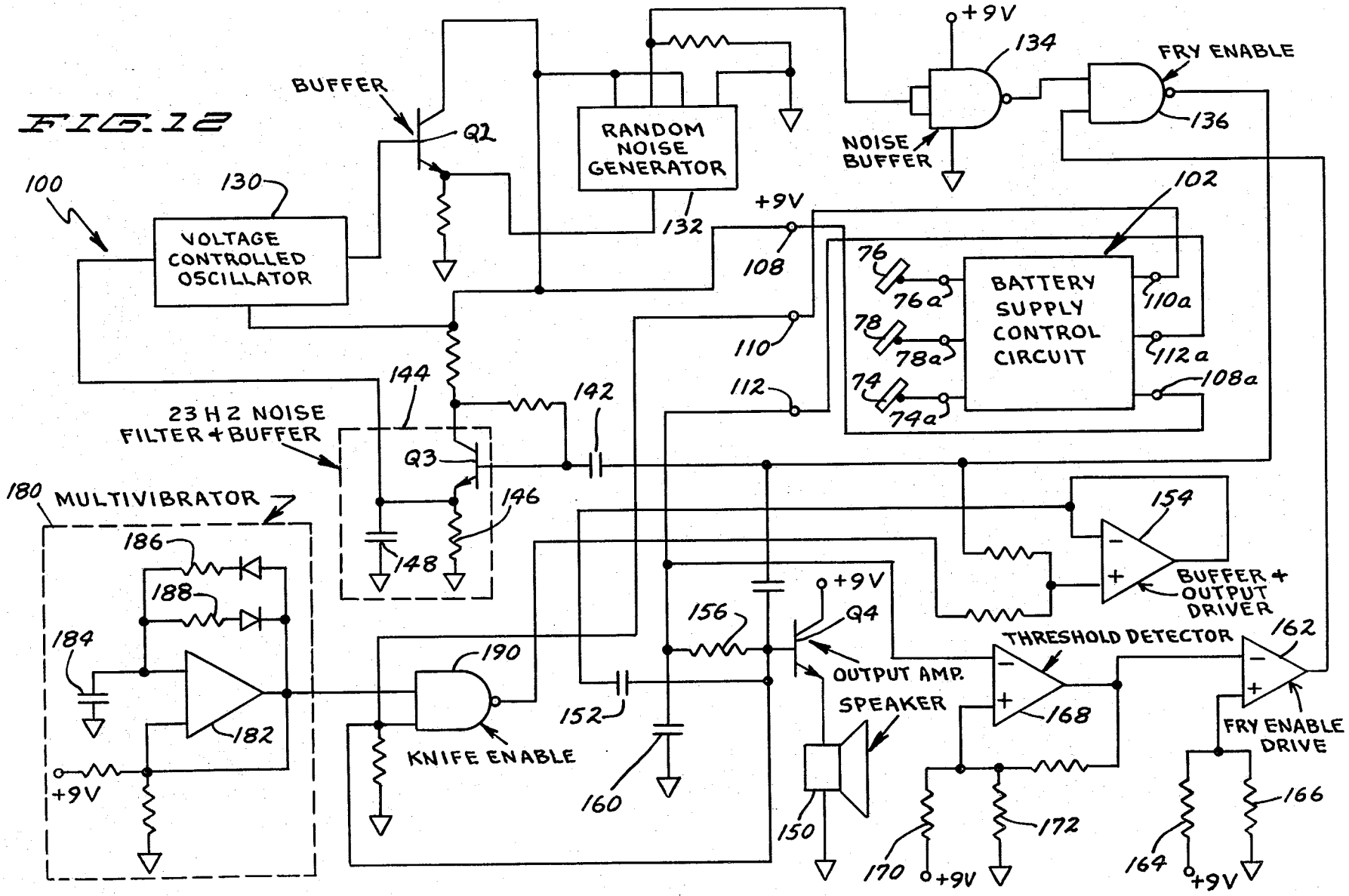

At this time reference will be made to FIG. 12 where one suggested electrical system embodying our invention is diagrammatically presented, the circuitry being indicated in its entirety by the reference numeral 100. The circuitry 100 is pictorially illustrated in FIG. 11, being comprised of an integrated circuit chip **100*a* mounted on a printed circuit board 100*b*. It is intended that the skillet 10 and knife 70 be powered by a battery which is contained in a battery supply control circuit indicated in its entirety by a block 102 in FIG. 12 and shown in detail in FIG. 13. The battery, which has been labeled 104, is shown pictorially in FIG. 10 and schematically in FIG. 13. More specifically, it is intended that a single 9-volt battery be employed. A connector 106 for this type of battery 104 appears in FIG. 11, having a negative snap-on contact 106*a* and a positive snap-on contact 106*b***.

The purpose of the battery supply control circuit 102 is to avoid any undue drain of current from the battery 104 until a piece of deformable material 90 is placed on the cooking surface 36 so as to bridge portions of the electrically conductive strips 40, 42, thereby providing a conductive path between the contacts 74 and 78, or such material 90 is engaged by the knife blade 70 so as to directly bridge the contacts 74 and 76.

With specific reference to the battery supply control circuit of FIG. 13, it should first be noted that the contacts 74, 76 and 78, which are located on the blade 70 as previously described, have been superimposed on this figure as well as on FIG. 12, in an effort to apprise the reader as to what transpires. The contacts 74, 76 and 78, it is to be observed, are connected to terminals **74*a*, 76*a* and 78*a*, respectively. Additional terminals 108*a*, 110*a* and 112*a* are connected to terminals 108, 110 and 112**, the purpose of which will presently be described.

An aim of the invention is to have the electrical system 100 remain virtually disconnected (with the exception of a number of integrated circuit devices used to effect a connection to those components that consume enough power to constitute a current drain on the battery) from the battery 104 until the deformable material 90, which is electrically conductive, causes connection. Because of this turn on feature, provision is also made for not having a child's hand complete the circuit. While the normal body resistance of a child is quite high, nonetheless there are times, such as when the child has just washed her hands or has been perspiring, when the body impedance is much lower than normal. To reduce the likelihood of having the system 100 inadvertently energized under such a condition, that is, to either produce a frying sound or an electric knife cutting sound, a resistor 114 is connected between the terminal **76*a* (also contact 76) and common, and a resistor 116 is similarly connected between the terminal 78*a* (also contact 78) and common. Since the battery 104 has its negative side connected to common and its positive side connected to the terminal 74*a* (also contact 74) it follows that the input resistance of the control circuit 102** can be set with proper ohmic values for the resistors 114, 116 such that the resistance of one's hand is not likely to activate the system 100. To have an electric knife slicing sound produced without the "food" that is, the material 90 being engaged, would detract from the realism of our invention.

The logic portion 118 of the control circuit 102 effects the turning on and off of a power gate or semiconductor switch in the form of a PNP transistor Q1. The transistor Q1 is normally biased into a non-conductive state, thereby effectively disconnecting the battery 104 from the terminal 108*a* (and also 108 which is connected to a number of electrical elements yet to be described that would constitute a current load on the battery 104). The logic elements, being integrated circuit devices, comprising the circuit portion 118 impose virtually no load on the battery 104, even though always connected between the positive and negative sides of the battery 104. Although all of the integrated circuit devices are continuously connected to the battery 104, the connection of only one such device has been shown.

The integrated circuit devices contained in the logic circuit portion 118 are conventional NOR gates of the so-called 4000 series. The extremely low power requirements of these integrated circuit devices can be appreciated from the descriptive material set forth on pages 600–605 of the book titled "Modern Microelectronics" by Max Fogiel, published in 1972 by Research and Education Association, 342 Madison Ave., New York, N.Y. 10017. These devices used as NOR gates have been assigned the reference numerals 118*a*, 118*b*, 118*c*, 118*e* and 118*j*, whereas the remaining gates are used as inverters and have been labeled 118*d*, 118*f*, 118*g*, 118*h* and 118*i*. More specifically, all of the integrated circuit devices 118*a*–118*j* are activated when a piece of electrically conductive material 90 is laid on the grid 38; only the devices 118*a*–118*g* and 118*j* are activated when material 90 bridges the knife contacts 74, 76.

Whenever the base of the PNP transistor Q1 is negatively biased this transistor Q1 is turned on or is switched into a conductive state to complete a circuit from the positive side of the battery 104 through its emitter-collector path to the terminal 108*a*, thereby applying substantially the full battery voltage to the terminal 108 to which various power consuming elements are connected, as will soon be made manifest. This is done through a base drive limiting resistor 120 connected between the base of the transistor Q1 and the output terminal of the NOR gate 118*b*. Of course, the output terminal of the gate 118*b* becomes negative when either of its input terminals becomes positive. Considering the lower input terminal of the gate 118*b* which is connected to the output terminal of the inverter 118*c*, it will be understood that the output terminal of the NOR gate 118*c* becomes positive when its upper input terminal becomes negative. Since the upper input terminal of the NOR gate 118*c* is connected to the output terminal of the NOR gate 118*a*, this negative condition is established when either input terminal of the NOR gate 118*a* has a positive signal impressed thereon. The upper input terminal of the NOR gate 118*a* is connected to the blade contact 76 through the terminal 76*a*, so when a piece of electrically conductive material 90 is engaged by the knife blade 70, more specifically its contacts 74 and 76, a circuit from the positive side of the battery 104 is completed to the upper input terminal of the NOR gate 118*a*. As just traced back from the NOR gate 118*b*, such a positive input produces a negative output from the NOR gate 118*b*, thereby switching the transistor Q1 from a quiescent state into a conductive state.

Owing to the two inverters 118*f* and 118*g*, a positive input voltage at the terminal 76*a* will cause a positive output voltage to be applied to the terminal 110 via the terminal 110*a* which is made use of in producing an electric knife slicing sound, as will soon be understood.

Since the lower input terminal of the NOR gate 118*a* is connected to the blade 78 via the terminal 78*a*, the transistor Q1 is turned on in the same manner outlined above when a circuit is completed through the contacts 74, 78 as a result of a piece of the material 90 being placed on the grid 38. Inasmuch as the terminal 78*a* is connected to the commoned input terminals of the inverter 118*d*, a negative output is produced at the output terminal of the inverter 118*d* and a positive output is in turn provided at the output terminal of the NOR gate 118*e*.

Whereas a fast turn on of the transistor Q1 is desired, a delayed turn off of this transistor is desired for reasons not yet presented. To provide the delay, an R-C circuit 122 is provided which includes a resistor 122*a*, a capacitor 122*b* and diode 122*c*. The rapid turn on of the transistor Q1 is effected by way of the lower input terminal of the NOR gate 118*b* which is connected to the output terminal of the NOR gate 118*c*, all as described above. Therefore, it is inconsequential that a small increment of time is taken for the capacitor 122*b* to become charged through the diode 122*c*. The important aspect of the matter is that it takes time for the capacitor 122*b* to become discharged when the gates 118*d* and 118*e* become inactive due to the removal of material 90 from the grid 38. Since a positive input to either input terminal of the NOR gate 118*b* produces a negative output which is applied to the base of the transistor Q1 through the limiting resistor 120, it follows that the discharge time maintains a negative bias on the transistor Q1 with the result that it remains turned on for a selected time interval after removal of the material 90 from the skillet 10, more specifically from its grid 38; this time interval has been selected to be about five seconds and the reason therefor will soon be explained.

Corresponding functionally to the inverters 118*f* and 118*g* are the inverters 118*h* and 118*i* since when material 90 completes an electrical path between the contacts 74, 78 via the grid 38 on which the material 90 has been placed, it follows that a positive potential is applied to the terminal 112 via a resistor 124 connected between the output terminal of the inverter 118*i* and the terminal 112*a*, once again for a purpose soon to be pointed out.

The NOR gate 118*j* provides a lockout function should the child attempt to cut any material 90 with the knife blade 70 while a piece of material 90 is on the skillet grid 38. In this regard, it is to be noted that its upper input terminal is connected to the output terminal of the inverter 118*f* having its input terminals connected to contact 76 via the terminal 76*c* and its lower input terminal connected to the output terminal of the inverter 118*h* which has its input terminals connected to contact 78 via terminal 78*a*. This results in the transistor Q1 being turned off with the consequence that neither a frying nor electric knife slicing sound is produced under these conditions.

With a detailed reference to FIG. 12, it will be noted that a voltage controlled oscillator has been set forth in block form, being labeled 130. Inasmuch as oscillators of this type are in common use and well known, the components constituting the oscillator 130 need not be shown. It can be explained, though, that the oscillator 130 has a nominal center frequency of 16 KHz. Later, it will be explained that this oscillator is frequently modulated with a band limited noise signal having an upper cutoff frequency of 23 Hz.

The output from the voltage controlled oscillator 130 is delivered to a buffer preferably in the form of an NPN transistor Q2, the output from the oscillator 130 being connected to the base of the transistor Q2. The buffer transistor Q2 drives the clock input of a 17 bit pseudo random noise generator 132. The output from the noise generator 132 is fed to a so-called noise buffer constituting a NAND gate connected as an inverter 134. The output terminal of the inverter 134 is connected to one input terminal of a "fry enable" component constituting a NAND gate 136 which, as its name implies, serves as an enabling circuit for the skillet 10 in the producing of a frying or sizzling sound. Whereas one input terminal of the NAND gate 136 is connected to the output terminal of the inverter 134, the other input terminal of the gate 136 is connected to a circuit component yet to be described.

A coupling capacitor 142 is connected to the output terminal of the NAND gate 136 and forwards the signal from this "fry enable" gate 136 to a low pass filter indicated generally by the reference numeral 144. The filter 144 is comprised of an NPN transistor Q3 having its base connected directly to the capacitor 142. The filter 144 also includes a resistor 146 and a capacitor 148, these latter components performing the desired filtering action. More specifically, the upper cutoff frequency of the low pass filter 144 is 23 Hz. Consequently, since the filter 144 is connected to the voltage controlled oscillator 130, a signal is impressed on the voltage controlled oscillator 130 that modulates this oscillator approximately plus or minus 1 KHz. All that really need be understood at the moment is that the noise generator 132, owing to its connection via filter 144 to the oscillator 130, provides a pseudo random frequency signal which is utilized in producing a frying or sizzling sound.

A speaker 150 actually emits the sound, being in circuit with an output amplifier in the form of an NPN transistor Q4. The base of the transistor Q4 is coupled by means of a capacitor 152 to the output terminal of a buffer and output driver constituting an operational amplifier 154. It should perhaps be pointed out that the operational amplifier 154, as well as three others hereinafter referred to, can all be of the LM324 type manufactured by National Semiconductor Corporation, 2900 Semiconductor Dr., Santa Clara, Calif. 95051. These are high gain, internally frequency compensated amplifiers capable of operating over a wide range of voltages. These op amps are available with four to a single package; the op amp 154 is thus one contained in a package of four. The op amp 154, it will be noted, is connected in the unity gain mode. It is of importance to recognize that the base of the amplifier transistor Q4 is also connected through a resistor 156 to the previously mentioned terminal 112.

Of considerable importance in practicing our invention is an envelope capacitor 160 which is likewise connected to the base of the transistor Q4 through the resistor 156. What occurs is that when a segment of the deformable material 90 bridges portions of the two electrically conductive strips 40, 42 of the grid 38 on the simulated cooking surface 36 of the skillet 10, then the capacitor 160 begins to charge through the resistor 124 of the battery supply control circuit 102 of FIG. 13. In describing the power supply control circuit 102 (shown only in block form in the electrical system diagrammed in FIG. 12) it was explained that the inverter **118*i* applies a positive output (actually 9 volts) through the resistor 124 to the terminal 112*a*, and hence to the terminal 112, when a circuit is completed between the contacts 74, 78 by reason of a piece of the electrically conductive material 90 having been placed on the grid 38. It takes approximately four seconds, although the time interval is susceptible to selection, for the voltage derived from the terminal 112 to build up on the capacitor 160 to the extent that a sufficiently positive bias is applied to the base of the transistor Q4 to turn on this transistor to its maximum output level. In other words, when a piece of deformable material 90 completes the circuit via the grid 38, the generation of a sound resembling the frying or sizzling of food does not occur at full volume until the capacitor 160 becomes fully charged. Hence, the frying sound builds up during the four seconds that the capacitor 160** is charging. This build-up provides a degree of realism that is quite important in practicing our invention.

It should be understood that the capacitor 160 will remain charged after the simulated food, that is, the material 90, has been removed from the cooking surface 36. This provides a decaying or fading away of the cooking sound which lends further realism to the overall use of the toy herein being described. In order to assure continued energization of the elements connected to the terminal 108, the time delay provided by the R-C circuit 122 is designed to be longer than the sizzle fading period (suggestively five seconds, as earlier mentioned).

It has been previously mentioned, although briefly, that the second input terminal of the "fry enable" gate 136 is connected to a certain component within the circuit 100. In this regard, a second operational amplifier 162, functioning as an inverter, has its output terminal connected to the second input terminal of the "fry enable" gate 136. One input of the last-mentioned amplifier 162 is connected to a voltage divider composed of resistors 164 and 166. The other input terminal of the amplifier 162 is connected to the output terminal of still another operational amplifier 168, this being the third in the package of four. Here again, one input terminal of the amplifier 168, functioning as a Schmitt Trigger, is connected to a voltage divider involving resistors 170 and 172, whereas its other input terminal is connected to the previously mentioned terminal 118. Thus, a portion or segment of the deformable material 90 must complete a circuit between portions of the electrically conductive strips 40, 42 of the grid 38 in order to activate the several operational amplifiers 154, 162 and 168.

Consequently, unless a sufficient amount of deformable material 90 is manually placed on the cooking surface 36 so as to bridge or span portions of the electrically conductive strips 40, 42 constituting the grid 38, the speaker 150 will not provide any output sound. In other words, under the circumstances being described at this time, a fry or sizzling sound is desired, but only when a segment of the deformable material 90 has been placed on the grid 38 and is completing a circuit.

It might also be pointed out at this stage that the input resistance of the circuit 100 is such that if a person placed his hand on the grid 38, there would generally be too much body resistance so that the circuit 100 still would not be energized to produce the sizzling sound. The value of the previously mentioned resistor 116 is selected to make sure that there is enough total resistance so that the sizzling sound will not result under most conditions. It is only when material having a sufficiently low electrical conductivity, such as that denoted by the reference numeral 90, is placed on the simulated cooking surface that sufficient current flows to energize the circuit 100 and produce the frying or sizzling sound. The resistance of the resistor 116 combined with that of the material 90, of course, should not be so great as to prevent the transistor Q1 from turning on; the transistor must be turned on in order to energize these circuit elements connected to the terminal 108.

The foregoing description has dealt with the generation of a sound resembling the actual cooking of food, more specifically a frying or sizzling sound. As far as producing a sound resembling that of an electric slicing knife, attention is directed first to a multivibrator denoted generally by the reference numeral 180. It includes an operational amplifier 182, which is the fourth op amp of the package of four. Unlike the sizzling or frying sound, the sound resembling that of an electric knife is of constant frequency. Therefore, the multivibrator 180 simply turns itself on and off at a rate such as to create or simulate an actual electric knife cutting sound. More specifically, it has been determined that an 83 Hz frequency with a 16% duty cycle creates a very realistic electric knife cutting sound. It should be borne in mind, though, that the knife cutting sound is to be generated only when some of the deformable material 90 is bridging the blade contacts 74 and 76, and the power supply control circuit assures this.

It is not believed necessary to describe in any detail the feedback paths from the output terminal to the two input terminals of the op amp 182. What occurs is that a capacitor 184 is charged and discharged, being charged through a resistor 186 and discharged more rapidly through a resistor 188 to produce the desired duty cycle, which has been mentioned as being 16%.

The output from the multivibrator 180 is delivered to one input terminal of still another NAND gate 190. The NAND gate 190 functions as a "knife enable" component. The other input terminal of the NAND gate 190 is connected to the terminal 110. In much the same manner as the terminal 112 is energized the terminal 110 is energized, via the inverters **118*f* and 118*g* of the power control circuit 102 rather than the inverters 118*h* and 118*i* used in applying a positive potential to the terminal 112. Of course, the transistor Q1 will, under these circumstances, be turned on so as to apply a positive 9-volt potential to the terminal 108. Thus, there must be a circuit completed between the knife blade contacts 74, 76 in order to have the NAND gate 190 provide a signal at its output terminal. The output terminal of the gate 190, it will be appreciated, is connected to the same input terminal of the op amp 154 that the output terminal of the gate 136** is connected.

It will be appreciated that the operational amplifier 154 constituting the buffer and output driver has its output terminal coupled through the capacitor 152 directly to the base of the transistor Q4 constituting the output amplifier for the speaker 150. The terminal 110 is also connected to the base of the transistor Q4, biasing the transistor Q4 to conduct the signal supplied by the buffer 154 causes Q4 to turn on and off so that the 83 Hz signal, after amplification is delivered to the speaker 150. In this way, the selected frequency of 83 Hz provides a very realistic knife slicing sound.

Only a few +9-volt terminals have been shown with conductors extending from the terminal 108. It will be appreciated that the op amps 154, 162, 168 and 182 are also energized via the terminal 108 which has +9 volts applied thereto only when the transistor Q1 has been turned on by reason of the material completing circuits as already described. It is, therefore, intended that all components requiring the application of 9 volts other than those contained in the battery supply control circuit 102 be energized through the terminal 108. These components contained within the circuit 102, being integrated circuit devices, require an insignificant amount of battery power. Thus, until a circuit is completed through a piece of electrically conductive material 90, the system 100 is for all intents and purposes effectively disconnected from the battery, thereby eliminating any real power drain when the skillet 10 and knife 52 are not being used.

Having presented the foregoing description of the system 100 set forth in FIG. 12, the block diagram of FIG. 14 should be readily understandable. Basically, with the exception of the envelope circuitry, the diagram set forth in FIG. 14 represents a completely digital system and has been given the reference numeral 200. In this instance, a clock generator 202 providing a 220 KHz output signal is utilized. The output of the clock generator 202 is fed to a pseudo random noise generator 204, which, as in the circuit 100, constitutes a 17 bit shift register. A clock modification logic circuit 206 is associated with the random noise signal generator 204 so as to, in effect, modulate the frequency of the clock generator 202 in a fashion resembling that done by the noise filter and buffer 144 of the circuit 100. It will be observed that the output from the random noise generator 204 is channeled to the speaker 150 via steering logic denoted by the reference numeral 208 and an output amplifier 210, the output amplifier 210 corresponding generally to the output amplifier Q3 in the circuit 100.

For the sake of brevity, an analog envelope circuit (which is one of two nondigital circuits) has been indicated only by the reference numeral 212. Basically, it performs the same function as the envelope capacitor 160 in FIG. 9. Since the envelope circuit 212 is to be operational only when deformable material 90 is bridging portions of the two electrically conductive strips 40, 42 of the grid 38 (and not when such material 90 is engaged by the blade contacts 74, 76), an envelope detector circuit 214 is included, controlling a power gate 216 which corresponds in function to the previously described battery supply control circuit of FIGS. 12 and 13.

It is planned that the clock generator 202 will provide a 220 KHz clock signal. Through the agency of a divider 218, the clock frequency is divided by 256 to provide the 83 Hz signal that has been previously mentioned as an appropriate signal for simulating the knife slicing sound. Associated with the divider 218 is a duty cycle logic circuit indicated by the reference numeral 220 which provides the same 16% duty cycle utilized in the circuitry 100 of FIG. 12. The duty cycle logic circuit 220 is connected through the same steering logic circuit 208 to the amplifier 210, and the amplifier 210, as already indicated, is directly connected to the speaker 150.

Hence, in the circuit 200, depending upon whether a fry sound is to be generated or a knife sound is to be generated, an input select circuit 222 determines whether the signal from the random noise signal generator 204 is to be delivered to the speaker 150 via the steering logic circuit 208 and the amplifier 210, or whether the clock signal be divided down by the divider 218 and processed by the duty cycle logic circuit 220 to provide the 16% duty cycle which on and off (16% on and 84% off) signal produces the desired electric knife slicing sound via the amplifier 210 and speaker 150.

It will be appreciated that the circuit 200 lends itself readily to fabrication as a semiconductor integrated circuit, containing the majority of the elements thereon.

In summary, as far as both embodiments 100 and 200 are concerned, the electrically conductive material 90 completes a circuit through the strips 40 and 42 of the grid 38 when placed on the cooking surface 36 of the skillet 10. Until the material 90 bridges or spans portions of the strips 40 and 42, the dielectric characteristics of the plastic from which the skillet 10 is fabricated maintains an open circuit condition. The inclusion of the various components 118*a*–118*i*, being integrated circuit devices, draw an extremely small amount of current from the battery 104.

With the material 90 placed on the grid 38, however, the transistor Q1 is turned on to connect the terminal 108 to the battery 104. Also, the battery voltage is applied to the terminal 112 via the devices 118*h* and 118*i*. This causes all of the components connected to these terminals 108, 112, to be energized, all being deenergized or inactive until this condition is established. It is then that the capacitor 160 can begin to charge with the consequence that the speaker 150 emits a steadily increasing frying or sizzling sound.

It should be appreciated that when the material 90 is removed from the skillet 10, the capacitor 160 begins to discharge, producing a sizzling sound of decreasing volume. During this happening the R-C circuit 122 maintains the transistor Q1 conductive for five seconds (an arbitrarily selected time interval) which is one second longer than the four seconds (also arbitrarily selected) it takes for the capacitor 160 to discharge and for the sizzling sound to decay. Stated more generally, the capacitor 122*b* should not discharge as rapidly as the capacitor 160.

By somewhat the same token, when the knife 50 is removed from beneath the skillet 10 and its blade 70, that is, its contacts 74 and 76, applied to a piece of material 90, then the transistor Q1 is turned on to again effect a connection of the battery to the terminal 108. Battery voltage under this condition is applied to the contact 110 via the devices 118*f* and 118*g*, causing the speaker 150 to produce a simulated electric knife slicing sound by reason of the gate 190 being enabled.

Should material 90 be simultaneously engaged by the grid 38 and the knife blade 70, the presence of the NOR gate 118*j* prevents the transistor Q1 from becoming turned on or productive, and if already conducting, as a result of either the material 90 being on the grid 38 or being engaged by the blade 70, the transistor Q1 will be immediately turned off or biased into its nonconductive state.

We claim:

1. A toy skillet comprising battery power supply means, electric sound-producing means for providing a sound simulating the frying of food, a bottom wall of dielectric material providing a simulated flat cooking surface on its upper side, first means including a grid composed of a pair of spaced electrically conductive strip members on said cooking surface in circuit with said power supply means and said sound-producing means, said grid extending over substantially all of said simulated cooking surface and said electrically conductive strip members comprising said grid normally having a sufficient amount of electrical resistance therebetween to prevent energization of said sound-producing means, and second means relatively movable with respect to said electrically conductive strip members, said second means including a deformable modeling compound which is sufficiently conductive to cause energization of said sound-producing means when one portion of said deformable modeling compound has been manually engaged with any portion of one of said electrically conductive strip members and another portion of said deformable modeling compound has been manually engaged with any portion of the other of said electrically conductive strip members to complete an electrical path between said electrically conductive members to cause energization of said sound-producing means and thus provide said sound simulating the frying of food.

2. A toy in accordance with claim 1 in which said strips include a layer of copper, and a layer of charcoal overlying said copper.

3. A toy skillet in accordance with claim 2 which said copper is secured to the upper side of said bottom wall and said charcoal being adhered to said copper.

4. A toy skillet in accordance with claim 3 including a protective coating overlying said charcoal.

5. A toy skillet in accordance with claim 1 including a first electric terminal extending from one of said electrically conductive strip members through the bottom wall of said skillet to the surface therebeneath, a second electric terminal extending from the other of said electrically conductive strip members through the bottom wall of said skillet to the surface therebeneath, and a switch contact connected to the lower end of each of said terminals.

6. A toy skillet in accordance with claim 5 in which said second means includes means for generating a random frequency noise signal to cause said sound-producing means to produce said sound resembling the frying of food, and contact means engageable with said switch contacts to effect energization of said random frequency noise signal generating means and said sound-producing means when said deformable modeling compound completes said electrical path between said electrically conductive strip members.

7. A toy skillet in accordance with claim 6 including a handle for said skillet, said random frequency signal generating means and said sound-producing means being contained in said handle.

8. A toy skillet in accordance with claim 7 in which said handle is releasably carried by said skillet, said handle having a knife blade thereon on which said contact means is mounted.

9. A toy skillet in accordance with claim 1 including means for providing a build-up of said simulated frying sound when said deformable modeling compound is placed on said simulated cooking surface.

10. A toy skillet in accordance with claim 9 in which said means for providing a build-up of sound provides a decaying sound when said deformable modeling compound is removed from said simulated cooking surface.

11. A toy skillet in accordance with claim 10 in which said means for providing a build-up of sound and a decaying of sound includes a capacitor.

12. A toy comprising a utensil in the form of a skillet having a simulated cooking surface associated therewith, means constituting a grid composed of a plurality of spaced electrical conductive strips secured to said surface providing a relatively high electrical resistive path between spaced locations on said surface, battery means for electrically energizing said electrically conductive strips to apply a voltage potential between said spaced locations, and a deformable modeling compond, a segment of which providing a relatively low electrical resistive path when manually placed in contact with said surface and extending between said spaced locations to cause electric current to flow between said spaced locations, and sound-producing means in circuit association with said electrically conductive strips and said battery means, said flow of current between said locations causing said sound-producing means to produce a sound when said deformable modeling compound has been manually placed on said surface and in contact with said spaced locations.

13. A toy utensil comprising a plastic vessel, means in said vessel providing a simulated cooking surface, an electrically conductive grid covering substantially all of said surface, said surface electrically insulating said grid, battery means for supplying electric power to said grid, manually positionable electrically conductive means in the form of a readily deformable modeling compound for bridging a portion of said grid, and electric sound-producing means in circuit with said grid, said sound-producing means being energized when said manually positionable means bridges a portion of said grid.

14. A toy utensil in accordance with claim 13 in which said modeling compound includes salt to render said compound electrically conductive.

15. A toy utensil in accordance with claim 14 in which said compound additionally includes wheat flour, water and a hydrocarbon distillate.

16. A toy utensil in accordance with claim 13 in which said compound contains on a weight percentage basis 30–60% wheat flour, 30–60% water, 1–5% hydrocarbon distillate and 10–25% salt.

17. A toy utensil in accordance with claim 16 in which said grid includes copper and charcoal, the copper being secured to said surface and said charcoal being secured to said copper.

18. A toy utensil in accordance with claim 17 including a protective coating overlying said charcoal.

19. In combination, a toy utensil having a simulated cooking surface with an electrically conductive grid thereon, means for applying power to said grid, means for producing a sound when an electrically conductive medium is manually placed on said simulated cooking surface in a bridging relation with a portion of said grid, and a toy knife, said knife having a pair of electrically conductive contacts so that when said electrically conductive medium is in bridging relation with said contacts by said knife being placed against said electrically conductive medium said sound-producing means is caused to produce a different sound.

20. The combination of claim 19 in which said electrically conductive medium causes said sound-producing means to produce a cooking sound when placed on the simulated cooking surface of said toy utensil, and in which said knife causes said sound-producing means to produce an electric knife slicing sound when said toy knife is placed against said medium.

21. In combination, a toy utensil of plastic material, strips of electrically conductive material affixed to a plastic surface portion of the utensil, the plastic surface between strips normally insulating said strips one from the other, means for maintaining adjacent strips at different electric potentials, electrically operated sound-generating means, electrically conductive means manually positionable on said surface to bridge two adjacent strips thereby causing current to flow from one adjacent strip to the next adjacent strip, means responsive to said current flow for causing said sound-producing means to produce a cooking sound, and a knife having a central strip of plastic material sandwiched between two electrically conductive strips, the plastic material of said central strip normally insulating said last-mentioned strips from each other, said means for maintaining said first-mentioned adjacent strips at different potentials also maintaining said last-mentioned strips at different potentials, said manually positionable means causing current to flow from one of said last-mentioned adjacent strips to the other of said last-mentioned strips, and means responsive to said last-mentioned current for causing said sound-generating means to produce an electric knife cutting sound.

22. The combination of claim 21 in which said knife includes a handle and blade, said sound-generating means being located in said handle and said blade including said central plastic strip and said two electrically conductive strips between which said central strip is sandwiched.

23. The combination of claim 22 in which said utensil has a well or pocket for receiving the blade of said knife.

24. A toy comprising a speaker, first circuit means for causing said speaker to produce a sound simulating a frying sound, first contact means associated with said first circuit means, control means associated with said first circuit means, an electrically conductive material for completing an electrical path to said control means, a battery supply control circuit for effectively preventing the supply of battery power to said first circuit means until said electrically conductive material has completed an electrical path to said control means, said battery supply control circuit including a battery, a normally nonconductive transistor in circuit with said battery and first circuit means, and means responsive to said battery voltage when the electrically conductive material completes said electrical path for causing said transistor to become conductive, a second circuit means for causing said speaker to produce a different sound simulating an electric knife slicing sound, second contact means associated with said second circuit means, each of said first and second contact means including a first or common contact and a second or separated contact, said first or common contacts being connected to both of said first and second circuit means, and the second or separated contact of said first contact means being connected to said first circuit means and the second or separated contact of said second contact means being connected to said second circuit means, said voltage responsive means including a first logic means connected to the second or separated contact of said first contact means and second logic means connected to the second or separated contact of said second contact means for causing said battery to apply voltage between said first or common contact and the second or separated contact of said first contact means when said material completes an electrical path to said first contact means, and to apply voltage between said first or common contact and the second or separated contact of said second contact means when said material completes an electrical path to said second contact means.

25. A toy in accordance with claim 24 including a skillet having a simulated cooking surface with an electric grid thereon, said grid being connected to said first contact means, and a knife having a blade, said blade having said second contact means thereon.

26. A toy skillet comprising a battery, a semiconductor switch, a circuit to be supplied with power from said battery, a logic circuit for closing said switch to connect said battery to said power-supplied circuit, spaced electrical contacts, one of which contacts is connected to said battery and the other of which contacts is connected to said logic circuit, said logic circuit being responsive to battery voltage when an electrically conductive and deformable modeling compound completes a circuit between said contacts, and resistance means of selected value associated with said other contacts for keeping said semiconductor switch open unless the impedance of said compound is sufficiently less than that of a person's hand.

27. A toy skillet in accordance with claim 26 including electric sound-producing means connected to said power supplied circuit.

28. A toy skillet in accordance with claim 27 in which said circuit includes means for causing said power supplied sound-producing means to emit a sound resembling the frying of food.

29. A toy skillet comprising power supply means, electrical signal-producing means for producing a sound resembling the frying of food, a simulated flat cooking surface, first means including a pair of spaced electrically conductive members on said cooking surface in circuit with said power supply means and said signal-producing means, said electrically conductive members normally having a sufficient amount of electrical resistance therebetween to prevent energization of said signal-producing means, and second means constituting a manually moldable compound relatively movable with respect to said electrically conductive members, said compound being deformable and sufficiently conductive to cause energization of said signal-producing means when said first and second means have been manually engaged with each other to complete an electrical path between said electrically conductive members.

30. A toy skillet in accordance with claim 29 in which said compound contains salt to render it electrically conductive.

31. A toy skillet in accordance with claim 30 in which said compound additionally contains wheat flour, water and a hydrocarbon distillate.

32. A toy skillet in accordance with claim 31 in which said compound contains on a weight percentage basis 30–60% wheat flour, 30–60% water, 1–5% hydrocarbon distillate and 10–25% salt.

33. A toy comprising power supply means, electric sound-producing means, means providing a simulated cooking surface of dielectric material, first means including a pair of spaced strips of electrically conductive material secured to said surface in circuit with said power supply means and said sound-producing means, said electrically conductive strips normally having a sufficient amount of electrical resistance therebetween to prevent energization of said sound-producing means, and second means constituting a deformable material which is sufficiently conductive to cause energization of said sound-producing means which material is relatively movable with respect to said electrically conductive strips, said deformable material being sufficiently conductive to cause energization of said sound-producing means when said deformable material completes an electrical path between said strips when manually placed on said simulated cooking surface with a portion of said deformable material engaging a portion of one of said strips and another portion of said deformable material engaging a portion of the other of said strips, and a knife having a blade thereon, said blade including a strip of dielectric material and a pair of electrical contacts, said dielectric strip being sandwiched between said electrical contacts.

34. A toy in accordance with claim 33 including means in circuit with said electrical contacts for causing said sound-producing means to provide a sound simulating an electric knife slicing sound when a circuit is completed through said electrical contacts via said deformable material.

35. A toy comprising power supply means, electric sound-producing means, first means including a pair of spaced electrically conductive members in circuit with said power supply means and said sound-producing means, said electrically conductive members normally having a sufficient amount of electrical resistance therebetween to prevent energization of said sound-producing means, second means relatively movable with respect to said electrically conductive members, said second means being sufficiently conductive to cause energization of said sound-producing means when said first and second means have been manually engaged with each other to complete an electrical path between said electrically conductive members, and a knife having a blade, said electrically conductive members being on said blade.

36. A toy in accordance with claim 35 in which said blade includes a strip of dielectric material and said electrically conductive members include strips of metal foil on each side of said dielectric strip, and in which said second means includes a deformable material for causing energization of said sound-producing means.

37. A toy comprising a utensil having a simulated cooking surface associated therewith, first means constituting a grid composed of a plurality of spaced electrically conductive strips secured to said surface providing a relatively high electrical resistive path between spaced locations on said surface, second means for electrically energizing said first means to apply a voltage potential between said spaced locations, said second means contacting portions of said strips placed on said surface and said strip portions constituting said spaced locations, and third means including a deformable material, a segment of said deformable material providing said relatively low electrically resistive path when placed on said surface and extending between said strip portions to cause electric current to flow between said spaced locations, a sound-producing means in circuit association with said first and second means, said flow of current between said locations causing said sound-producing means to produce a sound when said third means has been manually placed on said surface and in contact with said spaced locations, and a simulated knife which comprises a blade having spaced electrically conductive contacts, said deformable material bridging said spaced blade contacts when said blade contacts are placed thereagainst to cause flow of current from one of said blade contacts to the other, said last-mentioned flow of current causing said sound-producing means to produce a sound simulating an electric knife-cutting sound.

38. A toy comprising power supply means, electrical sound-producing means, first means including a knife having a simulated blade and a pair of spaced electrically conductive members thereon in circuit with said power supply means and said sound-producing means, said electrically conductive members normally having a sufficient amount of electrical resistance therebetween to prevent energization of said sound-producing means, and second means relatively movable with respect to said electrically conductive members, said second means being deformable and sufficiently conductive to cause energization of said sound-producing means when said first and second means have been manually engaged with each other to complete an electrical path between said electrically conductive members, said second means including a manually moldable compound containing on a weight percentage basis 30–60% wheat flour, 30–60% water, 1–5% hydrocarbon distillate and 10–25% salt to render said compound electrically conductive.

39. Toy means comprising a toy skillet and a toy knife removably held by said skillet, means for producing a first sound simulating a frying sound, second means for producing a second sound simulating an electric knife slicing sound, and means for preventing said first sound from being produced simultaneously with said second sound, said sound-preventing means including a first pair of electrical contacts on said skillet and a second pair of electrical contacts on said knife, said second contacts being engaged with said first contacts when said knife is held by said skillet and said second contacts being disengaged from said first contacts when said knife is removed from said skillet.

40. In combination, a toy skillet comprising a bottom wall, an electrical grid on the upper surface of said bottom wall composed of first and second electrically conductive strip members, a first electrical contact located beneath said bottom wall and electrically connected to said first strip, a second electrical contact located beneath said bottom wall and electrically connected to said second strip member, said first and second contacts being spaced somewhat from each other, and a toy knife including a simulated blade having a third electrical contact on one side thereof engageable with said first electrical contact, a fourth electrical contact on the other side of said blade engageable with said second contact, and a fifth electrical contact on said other side of said blade and separated from said fourth contact, first means for generating a simulated frying sound when said strip members are electrically connected to each other and said third contact is in engagement with said first contact and said fourth contact is in engagement with said second contact, and second means for generating a sound simulating a knife slicing sound when said third and fifth contacts are electrically connected.

41. A combination in accordance with claim 40 including an electrically conductive modeling compound for electrically connecting said strip members.

42. A combination in accordance with claim 40 including an electrically conductive modeling compound for electrically connecting said third and fifth contacts.

43. A combination in accordance with claim 42 in which said third contact constitutes a metal foil element on said one side of said blade and said fourth and fifth contacts constitute additional foil elements on said other side of said blade, those of said foil elements constituting said third and fifth contacts being adjacent one edge of said blade so as to be engageable with said electrically conductive modeling compound.

* * * * *

UNITED STATES PATENT AND TRADEMARK OFFICE

CERTIFICATE OF CORRECTION

PATENT NO. :4,383,386

DATED :May 17, 1983

INVENTOR(S) :George P. Giordano et al

It is certified that error appears in the above-identified patent and that said Letters Patent is hereby corrected as shown below:

Column 17, lines 28 and 29; "said circuit includes means for causing said power supplied sound-producing means" should be -- said power supplied circuit includes means for causing said sound-producing means --.

Signed and Sealed this

*Twenty-second* Day of *November 1983*

[SEAL]

*Attest:*

GERALD J. MOSSINGHOFF

*Attesting Officer*

*Commissioner of Patents and Trademarks*